US009140472B2

(12) United States Patent
Shin et al.

(10) Patent No.: US 9,140,472 B2
(45) Date of Patent: Sep. 22, 2015

(54) REFRIGERATOR WITH CONVERTIBLE CHAMBER AND OPERATION METHOD THEREOF

(75) Inventors: Gyuwon Shin, Gyeongnam (KR); Bongjun Choi, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 386 days.

(21) Appl. No.: 13/885,885

(22) PCT Filed: Oct. 24, 2011

(86) PCT No.: PCT/KR2011/007940

§ 371 (c)(1), (2), (4) Date: May 16, 2013

(87) PCT Pub. No.: WO2012/067354

PCT Pub. Date: May 24, 2012

(65) Prior Publication Data

US 2013/0219930 A1 Aug. 29, 2013

(30) Foreign Application Priority Data

Nov. 17, 2010 (KR) ..... 10-2010-0114662

(51) Int. Cl.

| | |
|---|---|
| ***F25B 29/00*** | (2006.01) |
| ***F25D 17/06*** | (2006.01) |
| ***F25D 23/00*** | (2006.01) |
| *F25B 6/04* | (2006.01) |
| *F25D 31/00* | (2006.01) |

(52) U.S. Cl.

CPC ..... *F25B 29/003* (2013.01); *F25D 17/065* (2013.01); *F25D 23/003* (2013.01); *F25B 6/04* (2013.01); *F25B 2400/0403* (2013.01); *F25B 2700/172* (2013.01); *F25D 31/005* (2013.01); *F25D 2323/0023* (2013.01); *F25D 2400/16* (2013.01); *F25D 2700/121* (2013.01); *F25D 2700/14* (2013.01)

(58) Field of Classification Search

CPC .... F25B 29/003; F25B 2700/172; F25B 6/04; F25B 2400/0403; F25D 23/003; F25D 17/065; F25D 31/005; F25D 2400/16; F25D 2323/0023; F25D 2700/121; F25D 2700/14

USPC ..... 62/181, 183, 196.4, 238.6, 441

See application file for complete search history.

(56) References Cited

U.S. PATENT DOCUMENTS

| | | | | |
|---|---|---|---|---|
| 4,355,521 | A * | 10/1982 | Tsai | 62/196.4 |
| 4,526,012 | A | 7/1985 | Chigira | |
| 5,056,328 | A | 10/1991 | Jaster et al. | |
| 2003/0097850 | A1 | 5/2003 | Chang et al. | |
| 2010/0100243 | A1 | 4/2010 | Lee et al. | |
| 2014/0208783 | A1 * | 7/2014 | Lee et al. | 62/89 |

* cited by examiner

*Primary Examiner* — Marc Norman

(74) *Attorney, Agent, or Firm* — Birch, Stewart, Kolasch & Birch, LLP

(57) ABSTRACT

A method for controlling temperature of a refrigerator including a main body having at least first and second adiabatic spaces; a refrigerant compression cycle device including an evaporator, a compressor, a condenser, and an expander installed within the main body; and a heating unit transferring heat of a refrigerant discharged from the condenser to air in the second adiabatic space, includes: measuring an internal temperature of the second adiabatic space; bypassing the refrigerant discharged from the condenser to the second adiabatic space when the measured internal temperature of the second adiabatic space is lower than a lower limit value of a pre-set temperature range; measuring ambient temperature of the condenser; and controlling an operation of a condenser cooling fan according to the ambient temperature of the condenser to maintain the refrigerant that passes through the interior of the condenser at a certain temperature or higher.

16 Claims, 4 Drawing Sheets

REFRIGERATOR WITH CONVERTIBLE CHAMBER AND OPERATION METHOD THEREOF

TECHNICAL FIELD

The present invention relates to a refrigerator having a convertible chamber and an operation method thereof and, more particularly, to a refrigerator having a convertible chamber capable of changing a refrigerating chamber or a freezing chamber into a space maintained at a pre-set temperature as necessary, and an operation method thereof.

BACKGROUND ART

General refrigerators include a freezing chamber for maintaining food items at a below zero temperature so as to be kept in a frozen state in storage and a refrigerating chamber keeping food items in unfrozen state in storage. The freezing chamber and the refrigerating chamber are demarcated by an insulating partition to have a determined volume, respectively, and a user cannot change the capacity or volume of the freezing chamber or the refrigerating chamber discretionally.

Thus, techniques allowing users to freely use the internal spaces of refrigerators according to purposes have been developed, and a refrigerator having a convertible chamber is one of those techniques. Namely, besides a general freezing chamber and a general refrigerating chamber, the refrigerator with a convertible chamber includes an additional space partitioned from the freezing chamber and refrigerating chamber and allows for a conversion of the internal temperature of the space as necessary. The convertible chamber can be operated as a freezing chamber or a refrigerating chamber according to a user selection, or may be used as a space maintained to have a different temperature from those of the freezing chamber and the refrigerating chamber.

In order to maintain the internal temperature of convertible chamber in the refrigerator, the internal temperature of the convertible chamber is lowered by using cold air generated by an additional evaporator for the convertible chamber or cold air generated by an evaporator for the freezing chamber or the refrigerating chamber. However, the user may increase the temperature according to circumstances, such as a case in which the user changes a low temperature environment to a high temperature environment. To this end, a heating means is required to increase the internal temperature of the convertible chamber. Here, an electric heater using electrical resistance heat may be used as the heating means.

The electric heater has an advantage in that it can easily control the internal temperature of the refrigerator by regulating the amount of applied current, but has a disadvantage that the necessity of additional power degrades energy efficiency.

Alternatively, a technique for utilizing a high temperature refrigerant, which has passed through a compressor, as a heat source has been proposed. This type of refrigerator heats the interior of the convertible chamber by using heat dissipated to the outside, without the necessity of additional power, improving energy efficiency. However, in order to increase the temperature of the convertible chamber, a refrigerating cycle must be necessarily operated, making it difficult to perform controlling, and since cold air is supplied to the freezing chamber or the refrigerating chamber while the convertible chamber is heated, increasing energy consumption.

DISCLOSURE OF INVENTION

Technical Problem

An aspect of the present invention provides a method for easily controlling temperature of a refrigerator in which a convertible chamber is heated by using a refrigerant of high temperature which has passed through a condenser.

Another aspect of the present invention provides a method for controlling a temperature of a refrigerator capable of improving energy efficiency in the process of heating a convertible chamber by using a refrigerant, which has passed through a condenser, as a heat source.

Solution to Problem

According to an aspect of the present invention, there is provided a method for controlling temperature of a refrigerator including a main body having at least first and second adiabatic spaces; a refrigerant compression cycle device including an evaporator, a compressor, a condenser, and an expander installed within the main body; and a heating unit transferring heat of a refrigerant discharged from the condenser to air in the second adiabatic space, including: measuring an internal temperature of the second adiabatic space; bypassing the refrigerant discharged from the condenser to the second adiabatic space when the measured internal temperature of the second adiabatic space is lower than a lower limit value of a pre-set temperature range; measuring ambient temperature of the condenser; and controlling an operation of a condenser cooling fan according to the ambient temperature of the condenser to maintain the refrigerant that passes through the interior of the condenser at a certain temperature or higher.

In this aspect of the present invention, the temperature of the second adiabatic space which may be used as a convertible chamber is increased by using the refrigerant of high temperature discharged from the condenser. In detail, a pipe through which the refrigerant of high temperature flows is disposed within a wall body of the second adiabatic space, or at least a portion of the pipe is exposed to the interior of the second adiabatic space to allow thermal energy of the refrigerant of high temperature to be transferred to the air within the second adiabatic space.

Here, the temperature of the refrigerant that has passed through the condenser may vary according to the surrounding environment in which the condenser is located. In particular, when the second adiabatic space is heated, cold air is also generated by the evaporator. Here, when the other remaining adiabatic space than the second adiabatic space is required to be cooled, such cold air may be provided, but when it is not required to be cooled, it would be better not to provide cold air to the other remaining adiabatic space. Thus, in such a case, the second adiabatic space should be heated as quickly as possible, so the refrigerant is required to be maintained at a certain temperature or higher in the condenser.

To this end, the ambient temperature of the condenser is measured and driving of the cooling fan for cooling the condenser is controlled according to the measured temperature to maintain the temperature of the refrigerant that passes through the condenser at the certain temperature or higher. Namely, when the ambient temperature is low, the driving of the cooling fan is stopped or the rotation speed of the cooling fan is lowered to reduce the amount of heat transmission from the refrigerant that passes through the condenser to prevent the temperature drop, and when the ambient temperature is high, the cooling fan is driven. In this case, an upper limit of the temperature of the refrigerant that passes through the condenser may be arbitrarily set by a skilled person in the art within the range in which the state appropriate for the operation of the refrigerant compression cycle device is maintained.

Here, in controlling the operation of the condenser cooling fan, the rotation speed of the cooling fan may vary according to a section to which the ambient temperature of the condenser belongs, and in this case, the rotation speed of the cooling fan in a section in which temperature is high may be higher than a rotation speed in a section in which temperature is low. Besides, the rotation speed of the cooling fan may be controlled to be proportional to the measured ambient temperature.

In controlling the operation of the condenser cooling fan, an operation duration of the cooling fan may vary according to a section to which the ambient temperature of the condenser belongs such that an operation duration of the cooling fan in the section in which temperature is high may be greater than that of the cooling fan in the section in which temperature is low. Besides, the operation duration of the cooling fan may be controlled to be proportional to the measured ambient temperature.

Also, the rotation speed and operation duration of the cooling fan may be controlled together according to the ambient temperature.

Meanwhile, the refrigerator may further include: a third adiabatic space insulated from the first adiabatic space and keeping ice in storage, and when the temperature of the first adiabatic space satisfies a certain temperature range in the step of bypassing the refrigerant to the second adiabatic space, cold air may be transferred to the third adiabatic space, thus enhancing the utilization of cold air. In this case, the third adiabatic space may be a space maintained at a below zero temperature, without a lower limit of the temperature range, e.g., an ice making chamber in which ice is kept in storage.

The method may further include: when the operation of the cooling fan is stopped in the process of operating the refrigerant compression cycle device, temporarily reducing the size of a voltage applied to the compressor so as to be smaller than a normal level.

As described above, when the operation of the condenser cooling fan is stopped to maintain the temperature of the refrigerant that passes through the condenser at a certain temperature level or higher, the refrigerant of relatively high temperature may be introduced to the compressor to potentially rapidly increase operational noise or vibration of the compressor. Thus, when the cooling fan is stopped, the size of the voltage applied to the compressor is temporarily reduced to prevent a rapid increase in noise and vibration.

Here, the reducing of the voltage applied to the compressor may include: operating the compressor for a certain period of time at a first voltage level lower than a normal voltage level; and operating the compressor during a certain period of time at a second voltage level lower than the first voltage level.

The operating of the compressor at the first voltage level or the second voltage level may be performed once or a plurality of times, and the method may further include: returning the voltage to have the normal voltage level after the lapse of a certain time since the voltage was reduced.

Meanwhile, a reference temperature TCL at which blowing of cold air to the second adiabatic space is stopped may be set to be higher than a reference temperature TRL at which bypassing of the refrigerant of high temperature to the second adiabatic space is initiated. If the reference temperature TCL is set to be lower than the reference temperature TRL, the internal temperature of the refrigerator would be lowered in the process of cooling the second adiabatic space by blowing cold air thereto, making the refrigerant of high temperature introduced to re-heat the second adiabatic space. In order to avoid this problem, the reference temperature TCL is set to be higher than the reference temperature TRL, to thus increase energy efficiency.

Here, when a lower temperature limit of the second adiabatic space is TMIN, a relational expression of $TRL<TMIN<TCL$ may be satisfied.

A reference temperature TRH at which bypassing of the refrigerant of high temperature to the second adiabatic space is stopped may be set to be lower than a reference temperature TCH at which blowing of cold air to the second adiabatic space is initiated. Thus, performing cooling while the second adiabatic space is being heated can be prevented.

Here, when an upper temperature limit of the second adiabatic space is TMAX, a relational expression of $TRH<TMAX<TCH$ may be satisfied.

According to another aspect of the present invention, there is provided a refrigerator including: a main body having at least first and second adiabatic spaces; a refrigerant compression cycle device including an evaporator, a compressor, a condenser, and an expander installed within the main body; a heating unit transferring heat of a refrigerant discharged from the condenser to air in the second adiabatic space; a condenser cooling fan installed at the condenser to cool the condenser; first and second dampers controlling the amount of cold air introduced to the first and second adiabatic spaces after being generated by the evaporator, respectively; and a controller controlling the operation of the compressor, the heating unit, and the condenser cooling fan, wherein when the second adiabatic space is heated by means of the heating unit, the controller controls the operation of the condenser cooling fan according to ambient temperature of the condenser to maintain the refrigerant that passes through the condenser at a certain temperature level or higher.

The heating unit may include: a bypass line having one end connected to a lower stream of the condenser and the other end connected to an upper stream of the expander, and transferring heat to the interior of the second adiabatic space; and a 3-way valve installed at a diverged point of the lower stream of the condenser.

The main body may further include: a third adiabatic space insulated from the first adiabatic space and keeping ice in storage, wherein the controller may provide control to transfer cold air to the third adiabatic space when the temperature of the first adiabatic space satisfies a certain temperature range in the process of bypassing the refrigerant to the second adiabatic space.

A check valve may be installed at the bypass line. Thus, the refrigerant of high temperature to be introduced to the expander can be prevented from being introduced to the second adiabatic space to affect the temperature of the second adiabatic space.

According to another aspect of the present invention, there is provided a refrigerator including: a main body including a freezing chamber, a convertible chamber, and a refrigerating chamber; first to third cold air adjusting units controlling the amount of cold air supplied to the freezing chamber, the convertible chamber, and the refrigerating chamber; a refrigerant compression cycle device installed within the main body and including an evaporator, a compressor, a condenser, and an expander; a bypass line bypassing a refrigerant discharged from the condenser; and a control unit controlling a refrigerant flow path to the bypass line, wherein the convertible chamber is cooled by the cold air and controlled to be heated by the bypass line so as to be maintained within a pre-set temperature range, and a condenser cooling fan cooling the condenser is controlled according to ambient temperature of the condenser in the process of heating the convertible chamber to maintain the refrigerant that passes through the condenser at a certain temperature level or higher.

Advantageous Effects of Invention

According to embodiments of the present invention, the temperature of the second adiabatic space corresponding to a convertible chamber can be maintained within an appropriate temperature range without having to supply power thereto, and thus, energy consumption in the process of maintaining the temperature of the second adiabatic space can be minimized.

The foregoing and other objects, features, aspects and advantages of the present invention will become more apparent from the following detailed description of the present invention when taken in conjunction with the accompanying drawings.

MODE FOR THE INVENTION

A refrigerator having a convertible chamber according to an embodiment of the present invention will now be described.

Figure 1:
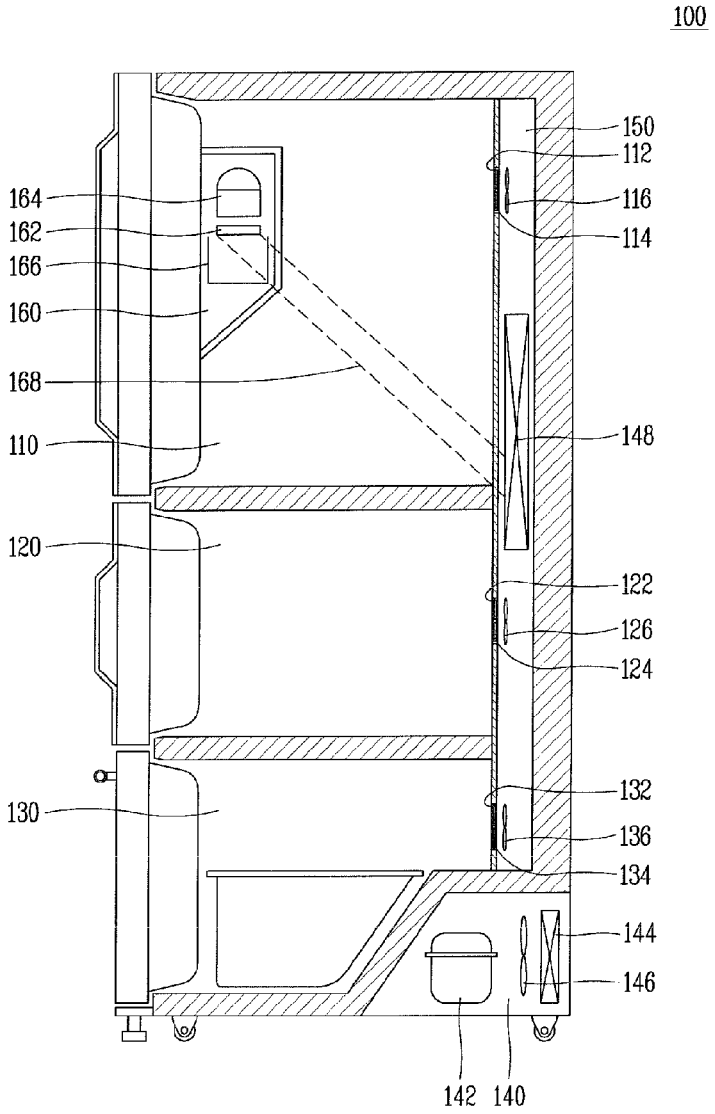
FIG. 1 is a view schematically showing an internal structure of a refrigerator having a convertible chamber according to an embodiment of the present invention.

FIG. 1 is a view schematically showing an internal structure of a refrigerator having a convertible chamber according to an embodiment of the present invention. With reference to FIG. 1, the refrigerator according to an embodiment of the present invention includes a main body 100 including a refrigerating chamber 110, a convertible chamber 120, and a freezing chamber 130 formed up and down. A mechanic chamber 140 is provided at one side of a lower portion of the main body 100. A compressor 142 and a condenser 144 constituting part of a refrigerant compression cycle device are disposed. A condenser cooling fan 146 is provided at the condenser 144 in order to accelerate heat dissipation of a refrigerant that passes through the condenser 144. An evaporator 148 and an expander 149 (See FIG. 2) are provided at a rear side of the main body 100 of the refrigerator.

In the refrigerator according to an embodiment of the present invention, cold air is supplied to the refrigerating chamber 110, the convertible chamber 120, and the freezing chamber 130 by using the single evaporator, but the present invention is not particularly limited thereto, and two evaporators may be provided for the freezing chamber 130 and the refrigerating chamber 110, respectively.

Cold air, heat-exchanged with the refrigerant that passes through the interior of the evaporator 148, is supplied to the refrigerating chamber 110, the convertible chamber 120, and the freezing chamber 130 through a duct 150 provided at the rear side of the main body 100 of the refrigerator. Here, cold air discharge holes 112, 122, and 132 are formed to allow cold air to be supplied to the refrigerating chamber 110, the convertible chamber 120, and the freezing chamber 130, and dampers 114, 124, and 134 for controlling supplying of cold air to the interior of the respective chambers are provided at the cold air discharge holes 112, 122, and 132. In addition, blow fans 116 126 and 136 are installed to be adjacent to the dampers 114, 124, and 134, respectively. Here, the disposition and shape of the duct 150 through which cold air is supplied are merely illustrative, and the present invention is not limited thereto. Namely, the duct 150 may be disposed to have any other shape. In addition, the positions and presences of the dampers 114, 124, and 134, and the blow fans 116, 126, and 136 may be determined by a skilled person in the art.

Meanwhile, an ice making chamber 160 is separately provided to be insulated from the internal space of the refrigerating chamber 110 within the refrigerating chamber 110. An ice maker 164 for making ice and an ice container 166 for keeping ice in storage are installed within the ice making chamber 160. Also, a cold air duct 168 for ice making chamber is formed within a side wall of the main body in order to supply cold air generated by the evaporator 148 to maintain the interior of the ice making chamber 160 at a temperature at which ice is not melt. A blow fan (not shown) for ice making chamber for controlling supplying of cold air to the cold air duct 168 for ice making chamber is disposed within the duct. Of course, the blow fan for the ice making chamber may not be necessarily installed within the duct; it may be installed to be adjacent to the duct such that it can blow cold air into the duct.

The convertible chamber 120 may be used as the refrigerating chamber 110 or the freezing chamber 130 according to a user selection, or may be used as a space maintained at a different temperature range from those of the refrigerating chamber 110 and the freezing chamber 130. Thus, when the internal temperature of the convertible chamber 120 is higher than a target temperature range, cold air may be supplied to cool the interior of the convertible chamber 120, and when the internal temperature of the convertible chamber 120 is lower than the target temperature range, the temperature of the interior of the convertible chamber 120 may be increased by using a heating unit. This may happen when the convertible chamber 120 is changed to have a high temperature range.

To this end, a bypass line is installed on a rear surface of the convertible chamber 120 to allow the refrigerant that has passed through the condenser 144 to go therethrough. Here, the bypass line may not necessarily be installed on the rear surface of the convertible chamber 120; it may be installed on a lower surface or an upper surface of the convertible chamber 120, or as illustrated, the bypass line may be exposed to the interior of the convertible chamber 120, or may be buried in the wall surface of the of the convertible chamber 120.

Figure 2:
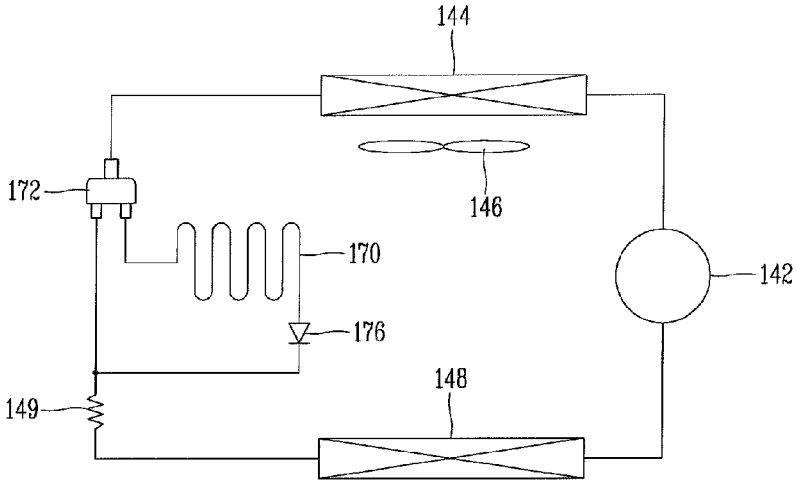
FIG. 2 is a block diagram showing the configuration of a refrigerant compression cycle device illustrated in FIG. 1 according to an embodiment of the present invention.

FIG. 2 is a block diagram showing the configuration of a refrigerant compression cycle device illustrated in FIG. 1 according to an embodiment of the present invention. With reference to FIG. 2, cold air is generated as a refrigerant sequentially flows through the compressor 142, the condenser 144, the expander 149, and the evaporator 148, and here, a bypass line 170 is installed between an outflow side of the condenser 144 and an inflow side of the expander 149. A 3-way valve 172 for controlling the direction of a flow of the refrigerant is installed at a diverge point of the bypass line 170.

A check valve 176 is provided at a portion immediately before a converge point at which the bypass line 170 is converged to the expander 149. The check valve 176 serves to prevent the refrigerant of high temperature introduced to the expander 149 from flowing backward to the bypass line 170 to affect the internal temperature of the convertible chamber 120.

Figure 3:
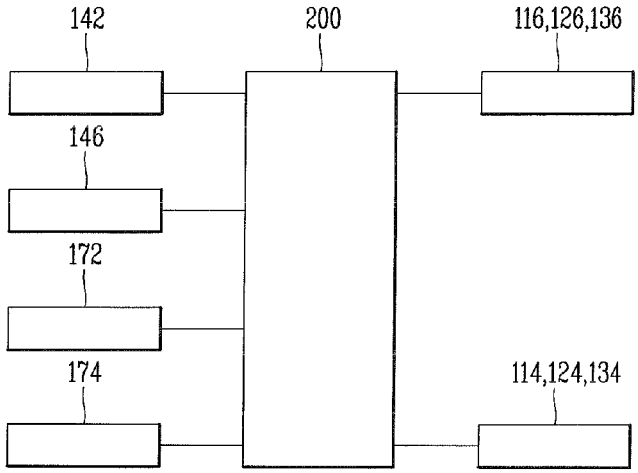
FIG. 3 is a schematic block diagram of a control system in FIG. 1 according to an embodiment of the present invention.

FIG. 3 is a schematic block diagram of a controller for controlling the operation of the refrigerant compression cycle device. With reference to FIG. 3, a controller 200 is electrically connected with the compressor 142 to control the operation of the compressor 142, and also configured to control the operations of the blow fan and the damper. Also, the controller controls the operation of the 3-way valve 172 and the condenser cooling fan 146, and here, the operation of the condenser cooling fan 146 is controlled according to ambient temperature measured by a temperature sensor 174 installed in the vicinity of the condenser 144.

Figure 4:
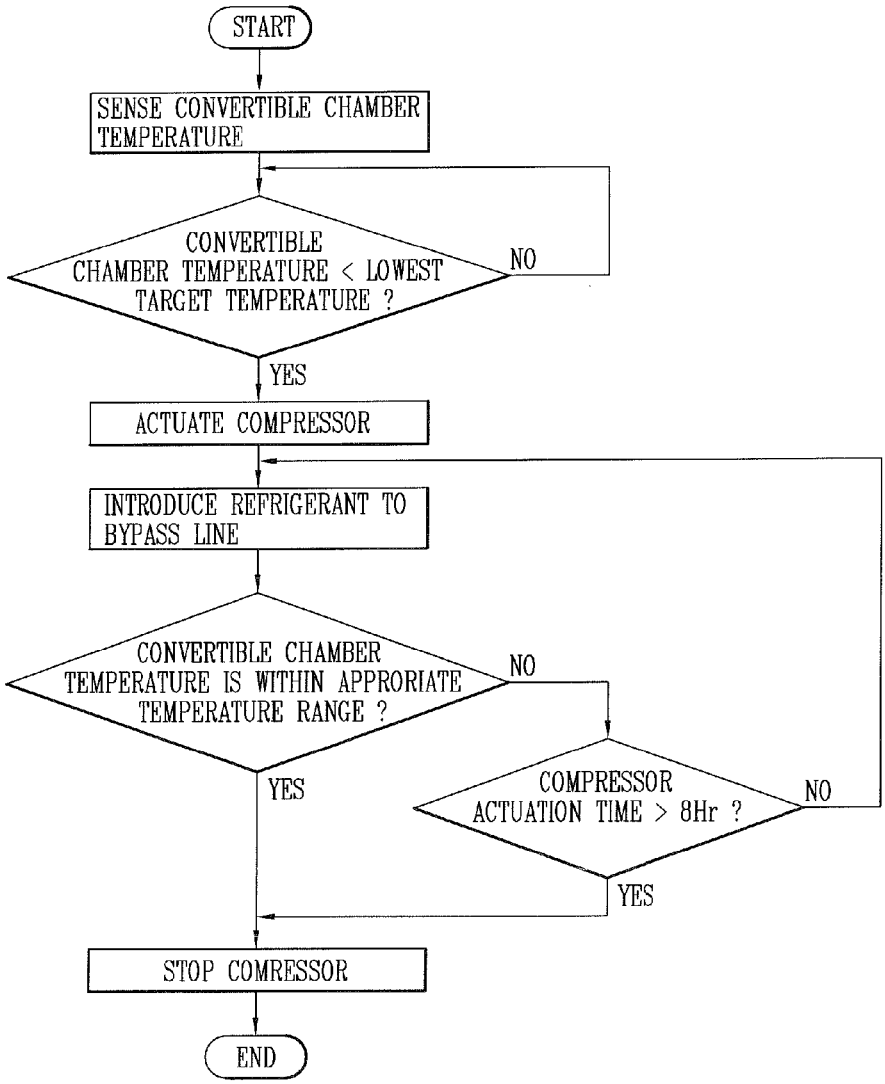
FIG. 4 is a flow chart illustrating the process of increasing the temperature of the convertible chamber in FIG. 1.

The operation of increasing the temperature of the convertible chamber 120 will now be described with reference to FIG. 4. When there is a user manipulation or when the internal temperature of the convertible chamber 120 is detected to be lower than a target temperature range, the controller 200 operates the refrigerant compression cycle device by applying a voltage to the compressor 142. At the same time, the controller 200 controls the 3-way valve 172 to allow a refrigerant discharged from the condenser 144 to be introduced to the bypass line 170. The refrigerant that has passed through the bypass line 170 has a high temperature, so it is heat-exchanged with air within the convertible chamber 120 to increase the internal temperature of the convertible chamber 120. This state is maintained while the internal temperature of the convertible chamber 120 is within an appropriate temperature range, but when the internal temperature of the convertible chamber 120 is not within the appropriate temperature range even after heating is performed by more than 8 hours, the controller 200 determines that a corresponding system has an error and stops the operation of the refrigerant compression cycle device.

In this case, when an ambient temperature of the condenser 144 detected by the temperature sensor is 27° C. or higher, the condenser cooling fan 146, maintaining a normal speed, is continuously actuated while the compressor 142 is operated. When the detected ambient temperature ranges from 22° C. to 27° C., the condenser cooling fan 146 is operated at a speed corresponding to 75% of the normal speed only in a partial duration of the period of time during which the compressor 142 is actuated. In detail, in the present embodiment, the refrigerant compression cycle device is actuated for 50 minutes in order to protect the corresponding system, stops from operation during a certain period of time, and then actuated for 50 minutes again. Thus, when the detected ambient temperature ranges from 22° C. to 27° C., the condenser cooling fan 146 is controlled such that it is not operated for 15 minutes immediately after the compressor 142 starts to be actuated, and operates only for 35 minutes that follows.

If the detected ambient temperature ranges from 18° C. to 22° C., the condense cooling fan 146 is controlled such that it is not operated for initial 35 minutes and then operated only for 15 thereafter at a speed corresponding to 75% of the normal speed. Finally, when the ambient temperature is lower than 18° C., the condenser cooling fan 146 is not operated.

The reason for controlling the operation of the condenser cooling fan 146 according to the ambient temperature is to maintain the refrigerant that passes through the bypass line 170 at a temperature level higher than a certain level. Namely, when the ambient temperature is low, the amount of heat transmission of the refrigerant that passes through the condenser 144 is increased, increasing the temperature of the refrigerant, and when the ambient temperature is high, the amount of heat transmission of the refrigerant is reduced, decreasing the temperature of the refrigerant. Accordingly, when the ambient temperature is low, the operation speed and operation time of the condenser cooling fan 146 are reduced to reduce the amount of heat transmission of the refrigerant, thereby controlling the refrigerant to have a temperature higher than a certain level.

This considers the fact that heating of the convertible chamber 120 and generation of cold air concurrently occur. For example, when the internal temperature of the freezing chamber 130 or the refrigerating chamber 110 is higher than an appropriate temperature range, the cold air generated in the course of heating the convertible chamber 120 may be supplied to the freezing chamber 130 or the refrigerating chamber 110, but when the freezing chamber 130 or the refrigerating chamber 110 has an appropriate temperature level, cold air cannot be supplied, so it would be desirous to actuate the refrigerant compression cycle device for a short time as possible. To this end, the temperature of the refrigerant that has passed through the condenser 144 is prevented from being excessively lowered, to force the temperature of the convertible chamber 120 to be increased quickly, thus minimizing the operation time of the refrigerant compression cycle device.

Here, cold air generated in the process of heating the convertible chamber 120 is controlled to be supplied to the ice making chamber 160. In case of the ice making chamber 160, although the temperature thereof is maintained at a lower level than the appropriate temperature range, it does not affect ice kept in storage therein, so cold air may be supplied to the ice making chamber. By doing that, the temperature of the evaporator can be prevented from being excessively lowered to affect the operation of the compressor 142.

Figure 5:
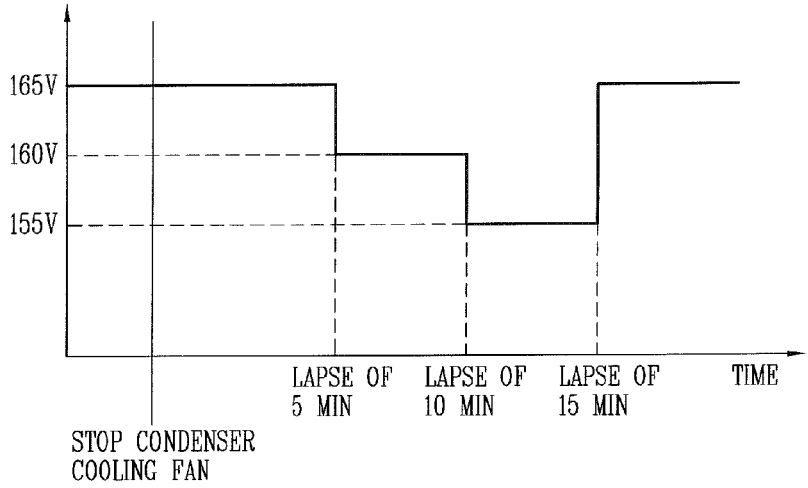
FIG. 5 is a graph showing a change in voltage applied to a compressor in the process of FIG. 4.

Meanwhile, when the operation of the condenser cooling fan 146 is stopped by the controller 200 while the refrigerant compression cycle device is being operated, a discharge pressure of the compressor 142 is rapidly increased due to the increase in the temperature of the condenser refrigerator, potentially generating vibration and noise. Thus, when the operation of the condenser cooling fan 146 is stopped, the voltage applied to the compressor 142 is lowered stepwise to reduce generation of vibration and noise. In detail, as shown in FIG. 5, voltage of 165V, normal voltage, is applied for five minutes immediately after the operation of the condenser cooling fan 146 is stopped, and voltage of 160V, lower than 165V, is applied for subsequent five minutes, and then, voltage of 155V, lower than 160V, is applied for subsequent five minutes, thus preventing an increase in the discharge pressure.

Figure 6:
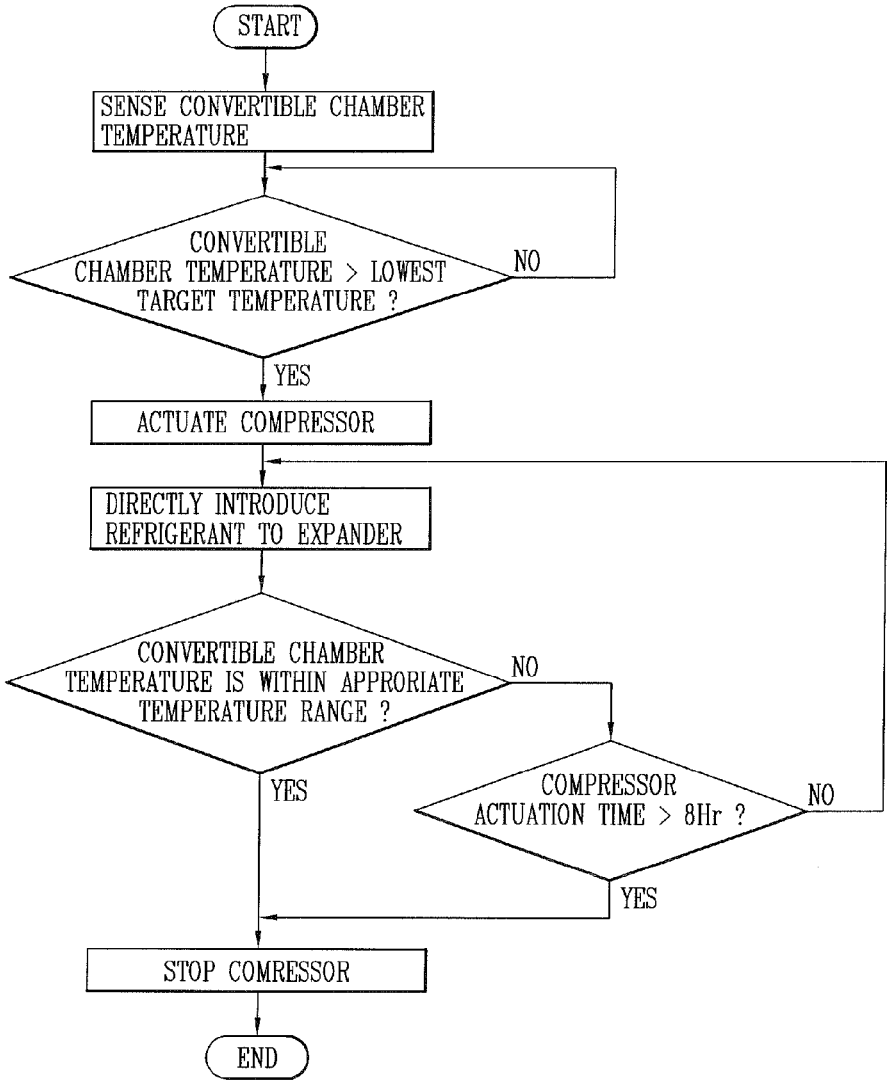
FIG. 6 is a flow chart illustrating the process of lowering the temperature of the convertible chamber in FIGS. 1.

A process of lowering the temperature of the convertible chamber 120 will now be described with reference to FIG. 6. With reference to FIG. 6, when there is a user manipulation or when the internal temperature of the convertible chamber 120 detected by the temperature sensor is higher than an appropriate temperature range, the compressor 142 is actuated and the 3-way valve 172 is controlled to allow a refrigerant discharged from the condenser 144 to be introduced to the expander 149 without going through the bypass line 170. Thus, the refrigerant generated by the evaporator 148 is introduced into the convertible chamber 120, lowering the internal temperature of the convertible chamber 120. This state is maintained while the internal temperature of the convertible chamber 120 is within an appropriate temperature range, and if the internal temperature of the convertible chamber 120 does not reach the appropriate temperature range although cooling is performed for 8 hours or more, the controller determines that the corresponding system has an error and stops the operation of the refrigerant compression cycle device.

Figure 7:
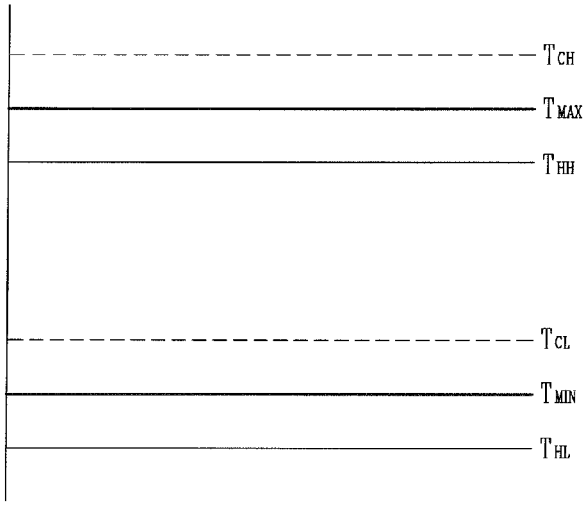
FIG. 7 is a graph showing a reference temperature for controlling the operation of a 3-way valve and a reference temperature for controlling supplying of cold air in FIG. 1 according to an embodiment of the present invention.

Meanwhile, when the internal temperature of the convertible chamber 120 is lowered or increased, cooling and heating is stopped according to whether or not the internal temperature of the convertible chamber 120 satisfies the appropriate temperature range. Here, a reference temperature for stopping the cooling or heating is set to be different from the appropriate temperature within the convertible chamber 120. Such temperature relationships are illustrated in FIG. 7. In FIG. 7, TMIN refers to the lowest optimum temperature within the convertible chamber 120, and TMAS refers to the highest optimum temperature within the convertible chamber 120. When the internal temperature of the convertible chamber 120 is lower than TMIN, which requires heating, heating is performed through the foregoing process. When the internal temperature of the convertible chamber 120 reaches THH, the heating operation is terminated. Here, THH is set to be lower than TMAX. If THH is equal to or higher than TMAX, since the temperature at the point in time when the heating was stopped is equal to or hither than TMAX, the controller 200 would supply cold air to the convertible chamber 120 to performing cooling, resulting in that an unnecessary operation is performed. Thus, THH is set to be lower than TMAX to prevent unnecessary cooling after the termination of the heating process. Here, although THH is set to be lower than TCH, a temperature at which cooling is initiated, the same effect can be obtained, but The point in time at which the cooling operation is terminated is required to be considered as described above. Namely, when the internal temperature of the convertible chamber 120 is higher than TMAX, cooling is performed, and when the temperature of the convertible chamber 120 reaches TCL, cooling is terminated. Here, it is set such that TCL>TMIN, thus preventing unnecessary heating immediately after the cooling operation is terminated. In this embodiment, THL, a temperature at which heating is initiated, is set to be lower than TMIN, and as a result, THL<TMIN<TCL.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

The invention claimed is:

1. A method for controlling temperature of a refrigerator including a main body having at least first and second adiabatic spaces; a refrigerant compression cycle device including an evaporator, a compressor, a condenser, and an expander installed within the main body; and a heating unit transferring heat of a refrigerant discharged from the condenser to air in the second adiabatic space, the method comprising:

measuring an internal temperature of the second adiabatic space;

bypassing the refrigerant discharged from the condenser to the second adiabatic space when the measured internal temperature of the second adiabatic space is lower than a lower limit value of a pre-set temperature range;

measuring ambient temperature of the condenser; and controlling an operation of a condenser cooling fan according to the ambient temperature of the condenser to maintain the refrigerant that passes through the interior of the condenser at a certain temperature or higher.

2. The method of claim 1, wherein, in controlling the operation of the condenser cooling fan, the rotation speed of the cooling fan varies according to a section to which the ambient temperature of the condenser belongs, and the rotation speed of the cooling fan in a section in which temperature is high is higher than a rotation speed in a section in which temperature is low.

3. The method of claim 1, wherein, in controlling the operation of the condenser cooling fan, an operation duration of the cooling fan varies according to a section to which the ambient temperature of the condenser belongs such that an operation duration of the cooling fan in the section in which temperature is high may be greater than that of the cooling fan in the section in which temperature is low.

4. The method of claim 3, further comprising:

when the operation of the cooling fan is stopped in the process of operating the refrigerant compression cycle device, temporarily reducing the size of a voltage applied to the compressor so as to be smaller than a normal level.

5. The method of claim 4, wherein the reducing of the voltage applied to the compressor comprises:

operating the compressor for a certain period of time at a first voltage level lower than a normal voltage level; and operating the compressor during a certain period of time at a second voltage level lower than the first voltage level.

6. The method of claim 5, further comprising:

after performing operating of the compressor at the first voltage level or the second voltage level once or a plurality of times, returning the voltage to have the normal voltage level.

7. The method of claim 4, wherein when an upper temperature limit of the second adiabatic space is TMAX, a relational expression of TRH<TMAX<TCH is satisfied.

8. The method of claim 1, wherein, the refrigerator further comprises:

a third adiabatic space insulated from the first adiabatic space and keeping ice in storage, wherein when the temperature of the first adiabatic space satisfies a certain temperature range in the step of bypassing the refrigerant to the second adiabatic space, cold air is transferred to the third adiabatic space.

9. The method of claim 1, wherein a reference temperature TCL at which blowing of cold air to the second adiabatic space is stopped is set to be higher than a reference temperature TRL at which bypassing of the refrigerant of high temperature to the second adiabatic space is initiated.

10. The method of claim 9, wherein when a lower temperature limit of the second adiabatic space is TMIN, a relational expression of TRL<TMIN<TCL is satisfied.

11. The method of claim 1, wherein a reference temperature TRH at which bypassing of the refrigerant of high temperature to the second adiabatic space is stopped is set to be lower than a reference temperature TCH at which blowing of cold air to the second adiabatic space is initiated.

12. A refrigerator comprising:

a main body having at least first and second adiabatic spaces;

a refrigerant compression cycle device including an evaporator, a compressor, a condenser, and an expander installed within the main body;

a heating unit transferring heat of a refrigerant discharged from the condenser to air in the second adiabatic space;

a condenser cooling fan installed at the condenser to cool the condenser;

first and second dampers controlling the amount of cold air introduced to the first and second adiabatic spaces after being generated by the evaporator, respectively; and a controller controlling the operation of the compressor, the heating unit, and the condenser cooling fan, wherein when the second adiabatic space is heated by means of the heating unit, the controller controls the operation of the condenser cooling fan according to ambient temperature of the condenser to maintain the refrigerant that passes through the condenser at a certain temperature level or higher.

13. The refrigerator of claim 12, wherein the heating unit comprises:

a bypass line having one end connected to a lower stream of the condenser and the other end connected to an upper stream of the expander, and transferring heat to the interior of the second adiabatic space; and a 3-way valve installed at a diverged point of the lower stream of the condenser.

14. The refrigerator of claim 13, wherein a check valve is installed at the bypass line.

15. The refrigerator of claim 12, wherein the main body further comprises:

a third adiabatic space insulated from the first adiabatic space and keeping ice in storage, wherein the controller may provide control to transfer cold air to the third adiabatic space when the temperature of the first adiabatic space satisfies a certain temperature range in the process of bypassing the refrigerant to the second adiabatic space.

16. A refrigerator comprising:

a main body including a freezing chamber, a convertible chamber, and a refrigerating chamber;

first to third cold air adjusting units controlling the amount of cold air supplied to the freezing chamber, the convertible chamber, and the refrigerating chamber;

a refrigerant compression cycle device installed within the main body and including an evaporator, a compressor, a condenser, and an expander;

a bypass line bypassing a refrigerant discharged from the condenser; and a control unit controlling a refrigerant flow path to the bypass line, wherein the convertible chamber is cooled by the cold air and controlled to be heated by the bypass line so as to be maintained within a pre-set temperature range, and a condenser cooling fan cooling the condenser is controlled according to ambient temperature of the condenser in the process of heating the convertible chamber to maintain the refrigerant that passes through the condenser at a certain temperature level or higher.

* * * * *